United States Patent [19]

Beuch

[11] Patent Number: 4,662,087

[45] Date of Patent: May 5, 1987

[54] HYDRAULIC FIT SYSTEM FOR FOOTWEAR

[75] Inventor: Donald R. Beuch, West Valley City, Utah

[73] Assignee: Force Distribution, Inc., West Valley City, Utah

[21] Appl. No.: 582,023

[22] Filed: Feb. 21, 1984

[51] Int. Cl.[4] ..... A43B 7/14; A43B 5/04; A43B 19/00; A43B 23/26

[52] U.S. Cl. ..... 36/88; 36/54; 36/71; 36/93; 36/119

[58] Field of Search ..... 36/117–121, 36/88, 89, 93, 105, 71, 29, 54

[56] References Cited

U.S. PATENT DOCUMENTS

| | | | |
|---|---|---|---|
| 3,758,964 | 9/1973 | Nishimura | 36/119 |
| 4,458,430 | 7/1984 | Peterson | 36/29 X |
| 4,502,470 | 3/1985 | Kiser et al. | 36/88 UX |

FOREIGN PATENT DOCUMENTS

| | | | |
|---|---|---|---|
| 0040189 | 4/1981 | European Pat. Off. | 36/117 |
| 1901606 | 8/1970 | Fed. Rep. of Germany | 36/119 |
| 2162043 | 6/1973 | Fed. Rep. of Germany | 36/117 |
| 2308547 | 8/1974 | Fed. Rep. of Germany | 36/71 |
| 2323417 | 11/1974 | Fed. Rep. of Germany | 36/93 |
| 2845824 | 5/1979 | Fed. Rep. of Germany | 36/119 |
| 2026062 | 9/1970 | France | 36/119 |
| 2142145 | 1/1973 | France | 36/119 |
| 2356384 | 1/1978 | France | 36/71 |
| 2508779 | 1/1983 | France | 36/29 |

*Primary Examiner*—James Kee Chi

*Attorney, Agent, or Firm*—Thorpe, North & Western

[57] ABSTRACT

A hydraulic regulated, space adjustment device for use within the interior of a footwear to adjust to specific space requirements of a foot as they vary during usage comprising a plurality of compartment which permits shifting of hydraulic fluid in response to forces applied to the footwear. The said device further comprises channels, flow regulating valves, and hydraulic fluid insertion means.

26 Claims, 8 Drawing Figures

HYDRAULIC FIT SYSTEM FOR FOOTWEAR

BACKGROUND OF THE INVENTION

1. Field of the Invention

This invention pertains to a hydraulically regulated pad for use within the interior of footwear to adjust to the specific space requirements of a foot as they vary during regular usage. More specifically, the present invention relates to a pad comprised of multiple compartments which permit the shifting of hydraulic fluid in response to forces applied to the footwear, such as through a buckle-closure system in a ski boot.

2. Prior Art

The difficulty of maintaining a comfortable fit of rigid footwear around the human foot represents a significant challenge. Each person has a foot shape which tends to be quite unique. This uniqueness not only extends to the dimensions in length and widths along the contours of the foot, but also to the arches and cavities. Achieving adequate support over the total foot surface is much more complicated, therefore, than taking linear measurements for the total confinement area. The various sizes of arches below and above the foot, as well as around the heel must also be considered.

Undoubtedly, the most demanding requirements for true fit footwear occur within sports activities. In this environment, froces applied to the foot test the adequacy of support and comfort. Furthermore, this support must respond to the dynamics of the sport. Abrupt movements and impacts are translated through the footwear and into the foot. Such influences result in significant modifications to the shape of the foot, which must be supported and protected for safety, as well as comfort.

Perhaps the most demanding footwear requirements arise in ski boots. Here, the foot is subject to changing forces with each change in terrain and movement. These forces are applied over the total surface of the foot, and not merely on the sole. For example, it is the foot and ski boot that control the turn, direction, glide and general action of the ski. Therefore, a snug, form-fit must be maintained in order to preserve response of the ski to each movement of the foot. Lack of proper fit leads to vertical and/or lateral sliding of the foot within the boot and resultant loss of control.

A particularly troublesome problem is the difficulty of keeping the heel in its seated position at the heel of the boot. Conventional skiing techniques require the skier to lean forward to maintain control of the skis. Although this operates to place the desired force at the tips of the skis, it also tends to lift the heels from their seated position. As the heels leave the heel socket, the ability of the skier to control lateral turns is significantly impaired.

It is therefore well known that proper fit of a ski boot in a static or standing condition does not ensure that adequate comfort and support will exist while traversing downhill terrain. Indeed, the more significant fit is the "dynamic" fit required during actual skiing activity. Unfortunately, this fit is very difficult to capture in a single mold because the shape and position of the foot is changing with each impact and new direction of movement. Hence, the dilemma exists of how to develop a fit which feel comfortable during both static and dynamic conditions, while maintaining the foot is a fully seated position within the ski boot.

Numerous attempts have been made to develop a more fluid type of containment for the foot. Inner linings of silicone powder have been made which are designed to improve form-fit of the boot. These have been unsuccessful in producing the type of dynamic adjustability needed. Single fluid pockets have been applied within a ski boot; however, these have not provided the required dynamic response necessary to keep the heel in position or provide a changing interior during actual skiing activity.

OBJECTS AND SUMMARY OF THE INVENTION

It is therefore an object of the present invention to provide a space adjustment device for use within the hard shell of footwear which adapts its interior shape to the dynamically changing positions or shapes of the foot.

It is a further object of the present invention to provide a footwear interior which changes shape in response to forces applied through the hard shell as it is closed or during movement of the foot, ankle or shin.

It is an additional object to provide a footwear interior which permits injection of variable amounts of liquid to adjust interior volume to a specific foot configuration.

A specific object of this invention includes development of a footwear interior which can be enlarged at the arch and/or heel sockets to provide uniform pressure and comfort.

These and other objects are realized in an hydraulically regulated, space adjustment device which comprises a plurality of thin, flexible compartments sealed to form an integral unit capable of retaining a hydraulic fluid medium therein. A narrow flow channel is coupled between the respective compartments to enable flow of the contained hydraulic fluid therebetween. A flow regulating means is positioned within this flow channel to impede unrestrained surges of fluid between the compartments as impact forces are applied within the footwear. A fluid injection entry is provided to enable introduction of hydraulic fluid into the compartments. Specific adaptions of the device are provided for a ski boot, as well as other sports and therapeutic applications.

Other objects and features of the invention will be apparent to those skilled in the art based upon the following detailed description taken in combination with the drawings identified as follows.

Figure 1:
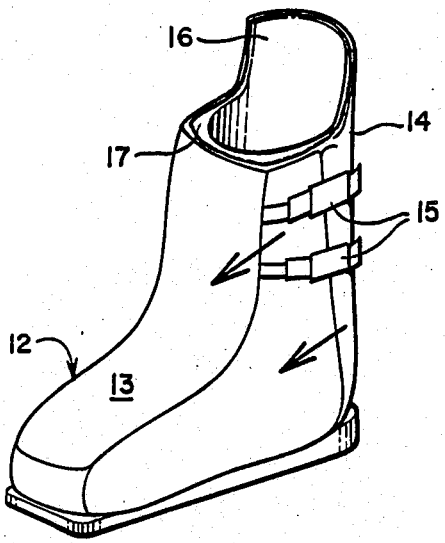
FIG. 1 is a pictorial view of a rear loading style ski boot.

Referring now to the drawings:

The present invention involves the use of a liquid hydraulic flow system within footwear to develop a form-fit specifically adapted to a specific foot size. Generally, the form-fitting structure utilizes several pockets or compartments containing a liquid or hydraulic fluid which operates as padding between the hard shell of the footwear and the foot of the user. As used herein, a "hard shell" is any part of the footwear which is nonelastic and designed to maintain its configuration around a contained foot. For example, leather, plastics and canvas used in athletic or therapeutic shoes may be considered to be a hard shell if it is not generally stretchable. Hard shell enclosures normally function to retain the enclosed foot within a specific volume.

Although various embodiments are disclosed herein, certain common features will be noted. For example, the subject space regulating device includes a plurality of thin, flexible compartments sealed to form an integral unit capable of retaining a thin liquid medium therein. The shape of the unit will vary with specific design requirements; however, it will generally be configured to fit inside a portion of the rigid shell at a position for contact at a portion of the foot which requires a dynamic form of support and containment.

Figure 2:
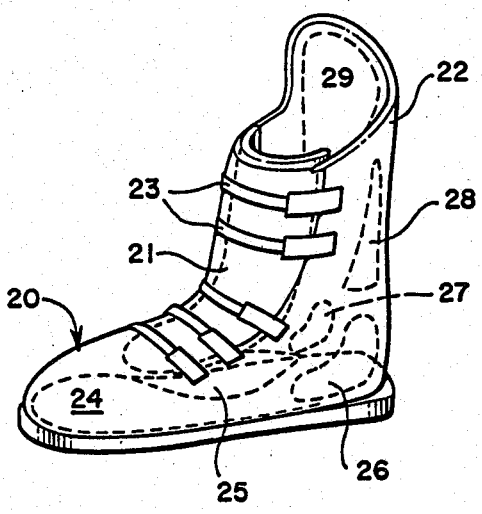
FIG. 2 is a pictorial view of a front loading style ski boot.

FIGS. 1 and 2 illustrate two embodiments of ski boots 12 and 20 representing rear-loading and front-loading styles. The rear-loading boot of FIG. 1 includes a rigid front shell 13 and back shell 14. It has a buckle closure system 15 which applies a driving force associated with the wedge shape of the boot as shown by the arrows. A padded insert 16 and 17 is provided as a cushion between the foot and hard shell.

The ski boot of FIG. 2 is a front loading boot because entry is made by opening the front buckles 23 and lifting the tongue 21. The back 22 remains fixed during and after entry. In this boot, the closure forces are applied against the forward part of the foot, wedging the heel into the heel socket.

As indicated above, the subject invention is designed to form-fit the interior of the hard shell to portions of the foot which require a dynamic or changing fit. Those areas of the foot which require special attention are shown in FIG. 2 and include the forward part of the shin and superior area of the arch covered by area 21 of the boot tongue. The lower arch 25 and sole 24 provide both comfort and support. The lower arch is particularly difficult to fit because its size is unique to each individual.

The heel portion of the foot is especially significant in ski control. It is represented by area 26 which contacts the exterior cavity and narrow portion of the foot between the heel, ankle bone and Achilles tendon. A smaller cavity is found on the opposite side of the heel contacting area 27. Finally, areas 28 and 29 represent the narrow part of the leg along the achilles tendon and back of the calf respectively. To properly fit a ski boot, these areas must be capable of adjusting to the changing configuration of the foot and leveraging forces which occur during skiing activity.

The present invention operates by pumping hydraulic fluid to or from these regions in response to differing or non-uniform forces. These forces initially arise from closure of the boot, but subsequently occur as the skier uses shifting weight or impacts with the terrain to control direction of travel. Because the hydraulic fluid is noncompressible, substantially all imposed forces are transferred between the boot shell and contained foot without significant attentuation by fluid compression.

The present invention allows an initial fit comfortable under static conditions to modify itself to a changing fit as the skier leans forward, backward or shifts his weight to either side. This is accomplished by fluid flow between connected compartments as shall be explained hereafter.

Figure 3:
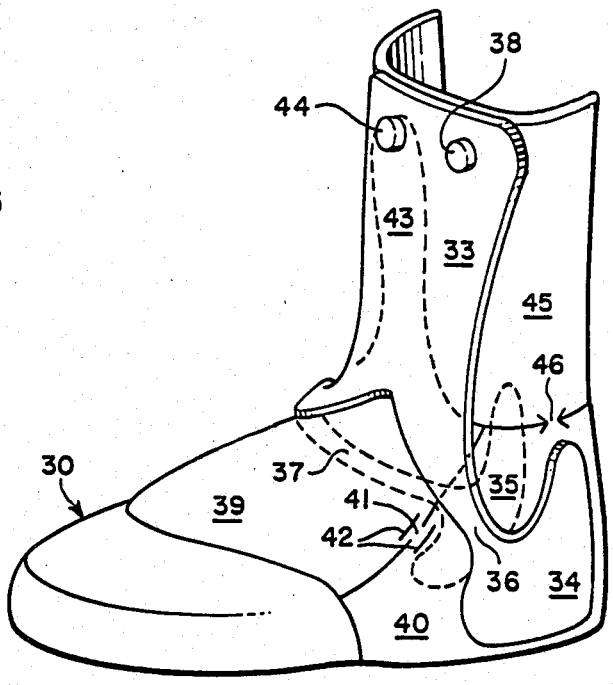
FIG. 3 is a pictorial view of an interior structure in accordance with the invention for positioning within the hard shell of an outer footwear member such as a ski boot.

To allow changing spatial adjustment around the foot, the plurality of compartments are connected by one or more flow channels. In FIG. 3, fluid reservoir 33 communicates with compartments 34 and 35 via flow channels 36 and 37 respectively. When used with rear entry boots, the tightening of the buckle system forces fluid from the primary pocket 33 into the heel socket areas 34 and 35. By selective adjustment of buckle pressure, the amount of fluid transferred into the heel pockets is regulated, yielding the proper fit. A snug fit is essential if proper control of the heel is to be maintained.

Flow channels 36 and 37 are restricted in size to prevent an undesirable surge of fluid between the parts. For example, a skier speeding down a hard-packed slope encounters severe vibrations. These vibrations translate into forces imposed on the respective fluid compartments. Each small impact can send fluid rushing into the adjacent compartment and results in loss of control while the foot is being driven from side to side in the boot.

To prevent such unrestrained flow, flow regulating means, such as the restricted channels 36 and 37 are provided. As used herein, flow restricting means includes any type of structure or device which operates to impede unrestrained flow of hydraulic fluids between compartments. The degree of restriction will depend upon the maximum weight of fluid flow which can be tolerated between any two compartments. Where higher flow rates can be tolerated, the use of a common flow channel having an opening substantially smaller than any cross section of the compartments may be adequate. Where greater flow regulation is required, use of a more direct impeding device may be necessary.

Compartment 39 and its adjacent lateral compartments such as item 40 illustrate the use of a flow regulating means which more severely limits fluid flow between compartments. Only the outside compartment 40 is shown; however, an inside compartment on the opposite of the footwear 30 would be used and would follow the same design, including use of a restricted flow device.

As illustrated in FIG. 3, this flow impedence device devises a labyrinth blocking wall 42 which prevents direct fluid flow through opening 41. The resulting tortious path establishes inertial resistance to surges to fluids between compartments 39 and 40. Therefore, upon the occurrence of a sharp jolt or turn on the left side of the boot, increased forces are applied to the fluid content in compartment 40. Instead of experiencing an immediate surge of fluid into compartment 39, only a gradual flow of fluid is permitted. If the applied force is only momentary, very little fluid exchange will occur and the compartments will remain dynamically stable, despite the rapid changing forces being applied.

The same scenario would apply to adjacent compartments 45 and 40, connected by opening 46. The application of gradually changing forces allows the fluid to adjust the volume along the contour of the foot. This occurs with initial entry into the boot as well as changes in foot size due to gradual swelling or gradual shifting of weight between downhill and traversing ski positions. The flow regulating means 46 operates to prevent the rapid undesirable rapid changes in volume which would otherwise adversely effect the stability of the ski boot.

Fluid injection means 38 and 44 are provided for controlled introduction of fluid into the primary compartments. For example, a syringe may be used through a seal sealing diaphragm at items 38 or 44, allowing injection of fluid through a penetrating cannula.

Other alternative injection means are envisioned. For example, a threaded cartridge may be mated with threaded openings 38 and 44 which enable the required fluid transfer. Such cartridges may be coupled to a pressure reading device which allows introduction of the fluid through a predetermined pressure level. It will be apparent to those skilled in the art that other techniques may be applied which may work equally well.

The various combinations of compartments respectively form integral units 33-34-35 and 39-40-45-43 which are configured together to provide an interior structure adapted for positioning within the hard shell of the footwear. Overlap of the integral units, as illustrated below the injection channel 43 where compartments 39 and 33 are overlapping, illustrate this arrangement. These compartments may be formed within an interior lining or may be used as separate inserts.

Figure 4:
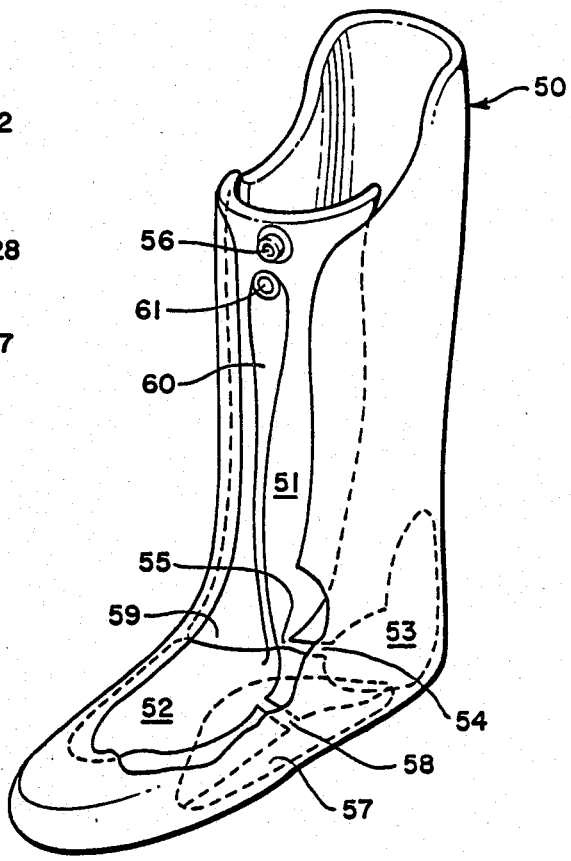
FIG. 4 is a pictorial view of another embodiment of an interior structure for footwear in accordance with the invention.

FIG. 4 shows another embodiment which provides additional support for the arch of the foot 57. In this case, an interior lining 50 includes a tongue element 51. This element 51 is a fluid compartment which communicates with the outside heel compartment 53 through a restrictive channel 54. The opening 55 to this flow channel is positioned at the base of the tongue compartment 51 to permit the tongue to be pulled out of the way for entry into the boot. The compartment 51 is filled with fluids through an injection port 56.

A second independent support device is provided by compartment 52 which is attached at the lower end of the tongue compartment 51 along a seam 59. Although they are attached, compartments 51 and 52 do not have a communicating opening. Instead, compartment 52 is cushioned over the superior arch of the foot and communicates to an arch support 57 through channel 58. An injection channel 60 allows communication with the fluid injection means 61. Both injection means 56 and 61 are positioned at the top of the boot for easy access and to avoid compression under a frontal closure system for the boot.

These respective units cooperate to adjust to special form fittings of the footwear interior to the contained foot as follows. A proper amount of fluid would be injected through ports 56 and 61 and to the primary ports 51 and 52. The lower portion of the footwear would be laced or buckled tight under sufficient pressure to cause fluid flow from compartment 52 into the arch support 57. The user knows when sufficient tension has been applied as the arch support feels comfortable and properly seated. The upper portion of the footwear is then tightened to provide gradual transfer into the heel compartment 53. A second heel compartment (not shown) at the other side would probably be charged from the same compartment 51. When the user feels that his heel is securely enclosed in its proper position, he would refrain from applying further pressure over the primary compartment 51. This represents a proper static fit, with the fluid adjustments having been accomplished by means of tension applied through the closure of the hard shell.

The dynamic transfer of fluids during movement of the foot can be illustrated with the same figure embodiment. Where the footwear constitutes a ski boot, the primary concern is the retention of the heel in the seated position at the heel of the ski boot. Whereas the heel customarily lifts out of place as the skier leans forward, such forward position applies additional force against the primary compartment 51. This increased force drives additional fluid through flow channel 54 into the heel bladders represented by item 53. Such increased flow has a tendency to tighten the grip around the heel and prevent its displacement from the seated heel position. The further forward the skier leans, the greater is the pressure and volume of the boot interior at the heel. In addition, the act of leaning forward tends to drive fluid to the lower portion of the bladder 51, increasing its volume. This increased volume further operates to push the foot down and rearward, keeping the heel in its seated position. A comparable result occurs as the arch support 58 is compressed, and increasing the volume in the primary bladder 52.

Figure 5:
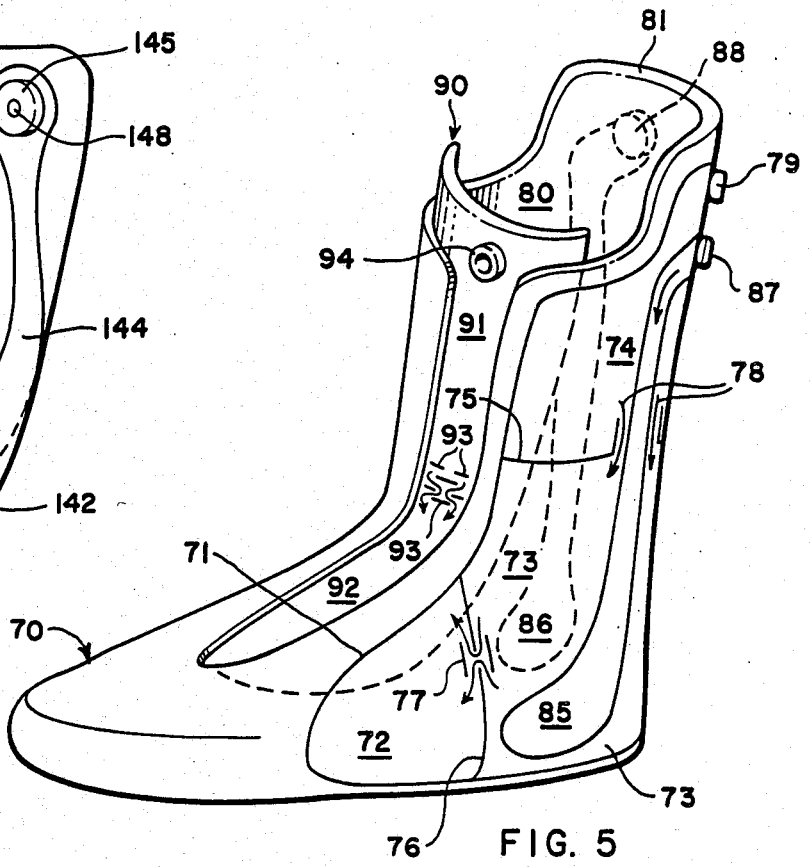
FIG. 5 is a pictorial view of yet another embodiment of an interior structure for footwear in accordance with the invention.

An additional embodiment is disclosed in FIG. 5 which is designed to provide lateral support to the footwear for a front loading boot, as is provided in FIG. 3 for a rear entry boot. A description of only one side which is shown in the figure as the outside of a foot where enclosed will be provided, the unillustrated side being substantially the same. In this case, a primary compartment 73 has a forward compartment 72 and and upper compartment 74 attached at its top. Flow channels with flow regulating means are provided at 77 and 78 respectively. 77 illustrates a labyrinth valve whereas 78 is merely a restrictive flow channel. These forward and top compartments are otherwise sealed by walls 75 and 76. Hydraulic fluid is injected through a port 79 at the top of the boot. A comparable arrangement of compartments might be positioned on the other side 80.

Item 81 might be a liner which properly positions the respective compartments within the footwear, or it may be part of one of the larger compartments which wraps around behind the calf of the leg. Additional support along the sides of the Achilles tendon and at the heel sockets may be provided by separate compartments 85 and 86. Fluid ports 87 and 88 are provided for injection of required fluid content. These compartments 85 and 86 may be sealed compartments within the unitary structure represented by 73-72-74, or may be compartments which are superimposed over the top thereof. In the subject configuration, the total integral unit is identified as item 71 and is supported within a footwear liner identified as item 70.

Dynamic control of fluids is provided at the tongue portion of the footwear represented by 91 and 92. A labyrinth valve 93 is positioned across an intermediate section of this tongue 90 to prevent surging of the fluid in response to abrupt impacts or forces. Injection of fluid is accomplished through port 94. The operation of both static and dynamic fluid transfer is substantially consistent with that described for FIGS. 3 and 4.

Figure 7:
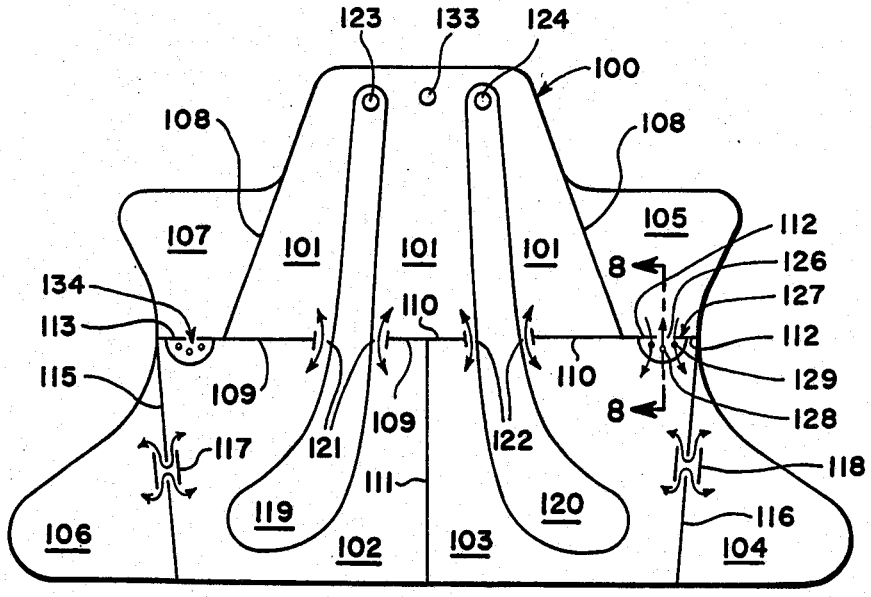
FIG. 7 is an elevational view of a specific wrap around support unit which can be used in the embodiment of interior structure shown in FIG. 5.

Greater detail of such a wrap around support unit is illustrated in FIG. 7. This embodiment comprises an insert which may be placed within a boot by the user, or may be built in as part of the fabrication process. The primary compartments consist of items 101, 102 and 103. The forward compartments 104 and 106, as well as upper compartments 105 and 107 are attached to the primary compartments 102 and 103. Each of these compartments is sealed by a seam or wall represented by elements 108, 109, 110, 111, 112, 113, 115 and 116. Where the compartments are formed between contacting layers of vinyl or plastic, these respective walls may be produced by RF sealing by a dye or other conventional process.

Labyrinth valves 117 and 118 are provided as flow regulating means between the lower compartments whereas valves 134, 127, 121 and 122 regulate fluid in an upper direction. Valves 121 and 122 comprise flow restricton channels wherein the minimal size provides the means for control. Valves 127 and 134 are unidirectional flap valves which increase the impedance against flow from primary compartments 102 and 103 into upper compartments 105 and 107.

Additional compartments 119 and 120 shown in FIG. 7 operate in a similar manner to compartments 85 and 96 shown on FIG. 5. The purpose of these compartments is to provide lateral support along the Achilles heel and at the cavity between the ankle bone and heel. The volume of compartments 119 and 120 are controlled by the amount of fluid injected through openings 123 and 124. Where compartments 119 and 120 are integrally formed with the total wrap-around unit 100, restrictive flow channels 121 and 122 are fixed in size. If, however, compartments 119 and 120 are superimposed over the integral structure 100, the amount of fluid filling 119 and 120 will also determine the degree of resistence against flow betwen compartment 101 and the respective compartments 102 and 103. If fluid volume is low in compartments 119 and 120 in the later superimposed embodiment, fluid flow extends underneath the respective compartments as well as through openings 121 and 122. Flow arrows have been generally included to indicate the nature of fluid transfer occurring between the various compartments. Compartment 101 is initially filled through an injection port 133.

Figure 8:
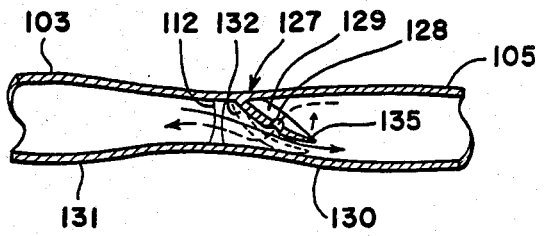
FIG. 8 is a cross sectional view of a flap valve as used in the structure of the present invention.

FIG. 8 shows a cross section of the flat valve 127 as previously referenced. This type of flow regulating means includes a valve member 129 which is coupled at one end to compartment wall 105. It is mounted so as to be biased at its free end 135 against the opposing compartment wall 130 as shown by the phantom outline at 132. In this closed position, flow from the right side to the left side is precluded, except for a very slow flow which seeps through opening 128. This flap valve 129 is positioned over the opening 126 which exists between sealed walls 112. This wall 112 defines the boundary between the fluid compartments 105 and 130, and 103 and its opposing wall 131.

The flap valve operates to permit normal flow through opening 126 in a direction from compartment 103 to compartment 105. For example, injection of fluid into the interval unit 100 through 133 results in fluid flow into compartment 103 and subsequently into compartments 104 and 105. Reverse flow from compartment 105 is reduced to a very slow rate because of the blocking operation of the flap valve 129. This valve could be applied in other regions where unidirectional flow is desired. The small openings 128 allow stabilization of fluid levels for longer periods of time.

Figure 6:
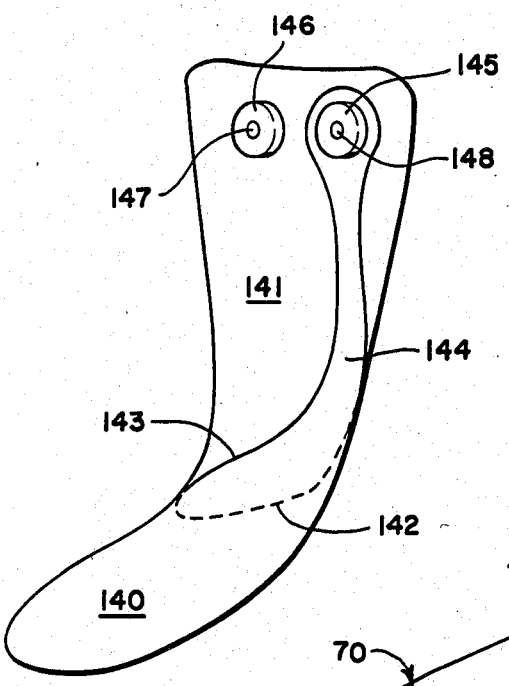
FIG. 6 is a pictorial view of a hydraulic cushion structure in accordance with the invention for anchoring the superior arch, shin and upper leg of a user.

An additional embodiment of a hydraulic device is shown in FIG. 6. This includes a lower compartment 140 to cover the superior arch and an upper compartment 141 to cover the shin and upper leg. These compartments are overlapping as shown by items 142 and 143 for two reasons. Not overlapping seams 142 and 143 avoid discomfort at the forward part of the ankle. Furthermore, during hydraulic operation of the boot, leaning drives fluid into the general region of 142-143, increasing the pressure at the ankle to maintain the heel in a seated position. As the skier returns to an upright position, the fluid reverts to its normal position throughout the respective compartments 140 and 141. The respective compartments are filled by injection means 145 and 146. Items 147 and 148 show the diaphragms through which a syringe penetrates to introduce the hydraulic fluid. In the case of injection port 145, a flow channel is provided 144 to transport fluid into the lower chamber 140.

The general configuration for the structure of FIG. 9 has been adapted for positioning at the forward part of the ski boot in the area illustrated as item 21 and FIG. 2.

The specific embodiments illustrated in the figures are not to be construed as limiting the scope of the present invention. For example, the same insert design could be applied to hockey skates, hiking boots or other athletic footwear. The identification of compartment locations and hydraulic fluid flow would be tailored to each sport, depending upon the distribution of forces across the footwear. The same device could be applied in a therapeutic shoe to maintain proper support over the foot surface. Other modifications and embodiments will be apparent to those skilled in the art, in view of the previous detailed description and drawings.

I claim:

1. An hydraulically regulated, space adjustment device adapted to conform the interior of a rigid footwear shell to the changing configuration of an individual's foot, said device comprising:

a. an interior, form-fitting liquid medium capable of being positioned laterally intermediate between the rigid shell and a contained foot and being fully contained within a thin, flexible compartment and adapted to be (i) form fitted to the foot by closure of the rigid shell about the foot and (ii) to be responsive to and to transfer forces developed thereat following boot closure between the rigid shell and the individual's foot without significant attenuation by fluid compression;

b. said liquid medium being contained within a plurality of thin, flexible compartments sealed to form an integral unit capable of retaining the liquid medium therein and having a size and configuration adapted to fit inside a lateral portion of the rigid shell of the footwear at a position for contact at a portion of the foot which requires a dynamic form of containment;

c. a narrow flow channel coupled between the respective compartments to enable flow of a contained hydraulic liquid therebetween;

d. flow regulating means positioned within the flow channel and adapted to impede unrestrained flow of hydraulic liquid between the respective compartments in response to an imbalance of force applied thereto by closure of the rigid shell or movement of the foot therein; and e. injection means coupled to at least one of the compartments to enable introduction of hydraulic liquid within the device.

2. A device as defined in claim 1 wherein the integral unit comprises a pair of elongated compartments joined together at respective ends by means of a common flow channel which has an opening substantially smaller than a cross section across any part of the compartments.

3. A device as defined in claim 2 further comprising a third compartment coupled to the pair of compartments by means of a flow channel which includes flow regulating means positioned within the second flow channel and adapted to impede unrestrained flow of hydraulic liquid between the pair of compartments and the additional third compartment, said third compartment having a size and configuration adapted to fit inside the rigid shell of the footwear at a position for contact at another portion of the foot requiring a dynamic form of containment.

4. A device as defined in claim 3 wherein the third compartment is shaped for positioning at a hollow portion of the heel of the foot to provide a form-fitting interior which applies uniform pressure over the contacted portion of the heel.

5. A device as defined in claim 4 wherein the pressure applied at the heel is generated by closure means (i) attached to the footwear and (ii) operable against the elongated pair of compartments to transfer hydraulic liquid through the flow channel connected at the third compartment, said closure means being capable of selective adjustment to apply a variable amount of force specifically suited to the foot of the user.

6. A device as defined in claim 5 further comprising a fourth compartment having a size and configuration adapted to fit inside the rigid shell of the footwear at a position for contact at the opposing hollow of the heel to provide a form-fitting interior which applies uniform pressure thereat, said pressure being generated by closure means (i) attached to the footwear and (ii) operable against the elongated pair of compartments to transfer hydraulic liquid through the flow channel connected at the fourth compartment, said closure means being capable of selective adjustment to apply a variable amount of force specifically suited to the foot of the user.

7. A device as defined in claim 6 wherein the third and fourth compartments are coupled to the same compartment pair and operable under pressure from the same closure means to provide a form-fitting compartment for the heel which is adjustable by the user, depending upon the amount of force selectively applied.

8. A device as defined in claim 7, wherein the closure means comprises an adjustable clamping means and the footwear comprises a ski boot.

9. A device as defined in claim 8 wherein one of the heel compartments having a position adapted for contact at the outside of the foot is substantially larger than the other compartment positioned for contact at the inside of the foot.

10. A device as defined in claim 6 further comprising flow regulating means positioned within at least one of the flow channels connected to the third or fourth compartments and adapted to impede unrestrained flow of hydraulic liquid from the compartment pair into the heel section of the footwear in response to closure of the rigid shell or movement of the foot therein.

11. A device as defined in claim 3 wherein one compartment of the integral unit is configured to fit over the forward shin and the other compartment is configured for positioning over the upper portion of the foot adjacent to the ankle, the combination providing a liquid reservoir which operates as a cushion against the rigid shell, as well as providing a source of hydraulic liquid for transfer to other parts of the foot in response to pressure occurring against the shin or upper foot.

12. A device as defined in claim 3 wherein the third compartment comprises an expandable arch support which can be adjusted in volume to fit one of a variety of arch sizes unique to the user's foot, the amount of liquid transferred and the resultant arch support volume being determined by the degree of pressure applied to the compartment pair.

13. Footwear having a device as defined in claim 1 wherein one of the compartments is positioned with the footwear at a location which would be over the top of the foot and a second compartment which comprises an expandable arch support which can be adjusted in volume to fit one of a variety of arch sizes unique to the user's foot, said respective compartments being connected by said flow channel with regulating means which permits transfer of hydraulic liquid contained within the first compartment to the second compartment to properly fill the arch space of the user upon closure of the footwear around the foot.

14. Footwear as defined in claim 13 wherein the footwear comprises a ski boot.

15. Footwear having a device as defined in claim 1 wherein one of the compartments is positioned within the footwear at a location which would be over the front of the shin and a second compartment which comprises a compartment shaped for positioning at a hollow portion of the heel of the foot to provide a form-fitting interior which applies uniform pressure over the contacted portion of the heel.

16. Footwear as defined in claim 16 wherein the footwear comprises a ski boot, said flow channel being connected at a base portion of the first compartment positioned at approximately the area where the ankle is to be contained to enable the boot to be opened for placement on the user's foot.

17. A device as defined in claim 1 wherein the integral unit comprises a single compartment sealed around the periphery and segmented by the flow regulating means across an intermediate section to divide the integral unit into two subcompartments, said flow regulating means comprising at least one connecting flow channel configured with a nonlinear, tortious flow path.

18. A device as defined in claim 17, wherein the tortious flow path is formed by a labyrinth of barrier walls in substantial separated, parallel alignment to form a series of narrow flow channels between adjacent barrier walls, each wall having an opening to allow liquid flow to the next barrier wall or compartment, said integral unit having a shape adapted for positioning between a forward tongue portion of the footwear and the user's foot.

19. A lateral support and form-fitting device as defined in claim 1 wherein the integral unit includes at least one large compartment subdivided into at least three subcompartments, at least one of which is a primary compartment having narrow flow channels with flow regulating means connecting to each of the two remaining subcompartments at a top and side position respectively, said integral unit having an overall configuration adapted for placement with the side subcompartment extending forward among the side of the foot and the top subcompartment extending upward from the ankle.

20. A device as defined in claim 19 comprising two lateral support units which are joined at one edge of the respective top subcompartments and primary compartments to form a composite integral unit adapted to wrap around the foot within the footware to provide support at the back and respective sides of the foot.

21. A device as defined in claim 19, further comprising a sealed, L-shaped compartment having the spine of the L attached in vertical orientation along the top subcompartment and the leg of the L configured and positioned to fit over the cavity of the heel, said L-compartment having means for injecting liquid to selectively adjust the volume thereof to form-fit the user's heel cavity in combination with the lateral support unit.

22. A front loading ski boot having a wrap around back and lateral support unit as described in claim 20, and further comprising boot closure means coupled across the front of the boot and operable to apply the required force through the back part of the boot to displace a contained hydraulic liquid among the compartments to form-fit the boot interior to the lateral foot configuration of the user.

23. A device as defined in claim 1, wherein the flow regulating means comprises a narrow opening between the walls of adjacent compartments, said opening size being adapted to prevent a surge of liquid between compartments in response to abrupt and dynamic forces applied to the footware.

24. A device as defined in claim 23, further comprising a thin flap positioned across the opening within the compartment intended to receive hydraulic liquid in response to initial applied forces said flap being biased in a closed position against the opening to impede a surge of liquid flow in a forward direction and block reverse flow.

25. A device as defined in claim 24, wherein the flap includes at least one small opening which communicates with the wall opening, said flap opening being sufficiently small to permit only a gradual seeping of liquid in the reverse

26. An hydraulically controlled tongue for a ski boot which allows the ankle and shin of the user to adjust positioning within the boot during dynamic changes which occur during various types of skiing maneuvers, said tongue comprising:

a. an interior, form-fitting liquid medium capable of being positioned laterally intermediate between the rigid shell and a contained foot and being fully contained within a thin, flexible compartment and adapted to be (i) form fitted to the foot by closure of the rigid shell about the foot and (ii) to be responsive to and to transfer substantially all forces developed thereat following boot closure between the rigid shell and the individual's foot without significant attenuation by fluid compression;

b. said liquid medium being contained within a first sealed compartment adapted to receive hydraulic liquid and to be positioned over the top portion of the foot enclosure; and c. a second sealed compartment adapted to receive hydraulic liquid and to be positioned over the upper shin enclosure, said respective compartments being attached together such that the lower part of the second compartment overlaps the upper part of the first compartment, each of said compartments having means for injecting hydraulic liquid therein.

* * * * *